US005112261A

United States Patent [19]

Humphrey

[11] Patent Number: 5,112,261

[45] Date of Patent: May 12, 1992

[54] REVERSE BOAT OARS

[76] Inventor: James A. Humphrey, 15930 Menlo Ave., Gardena, Calif. 90247

[21] Appl. No.: 683,701

[22] Filed: Apr. 11, 1991

[51] Int. Cl.[5] ..... B63H 16/10

[52] U.S. Cl. ..... 440/103

[58] Field of Search ..... 440/103; 416/74

[56] References Cited

U.S. PATENT DOCUMENTS

| | | | |
|---|---|---|---|
| 562,369 | 6/1896 | Berron | 440/103 |
| 727,731 | 5/1903 | Anderson | 440/103 |
| 1,552,966 | 9/1925 | Speckhardt | 440/103 |
| 1,689,714 | 10/1928 | Burns | 440/103 |
| 1,704,074 | 3/1929 | Bilesfine | 440/103 |
| 2,003,418 | 6/1935 | Ankarlo | 440/103 |
| 2,415,432 | 2/1947 | Krueger | 440/103 |
| 3,884,175 | 5/1975 | Bellis | 440/103 |

*Primary Examiner*—Sherman D. Basinger
*Attorney, Agent, or Firm*—Richard L. Miller

[57] ABSTRACT

A reverse boat oar is provided and consists of a mechanism for holding a large gear portion on a distal end of an oar handle arm and a small gear portion formed on a distal end of an oar paddle arm in a meshing rotatable relationship. An oar lock attaches the holding mechanism to a gunwale of a boat, so that when a rower pushes forward on the oar handle arm the oar paddle arm will also go forward. The rower can sit facing the bow of the boat to see where the boat is going.

1 Claim, 1 Drawing Sheet

REVERSE BOAT OARS

SUMMARY OF THE INVENTION

A primary object of the present invention is to provide a reverse boat oar that will overcome the shortcomings of the prior art devices.

Another object is to provide a reverse boat oar that allows a rower to sit facing the bow of the boat instead of facing the stern of the boat.

An additional object is to provide a reverse boat oar that by pushing forward on the oar handle arm will cause the oar paddle arm to also go forward and by pulling back on the oar handle arm will cause the oar paddle arm to travel back allowing the rower to see where they are going.

A further object is to provide a reverse boat oar that is simple and easy to use.

A still further object is to provide a reverse boat oar that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
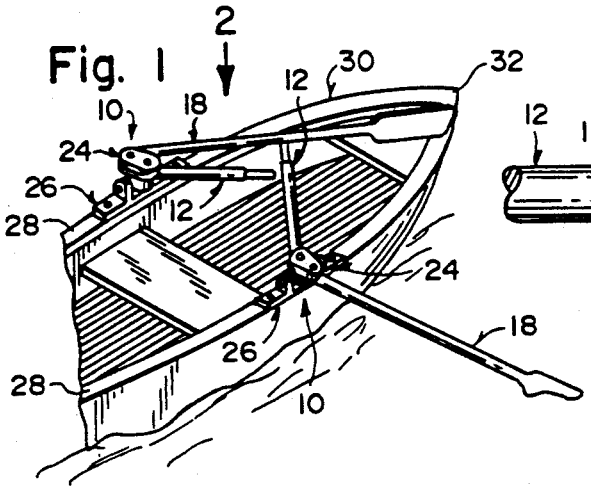
FIG. 1 is a perspective view of a boat with the instant invention installed thereon.
Figure 4:
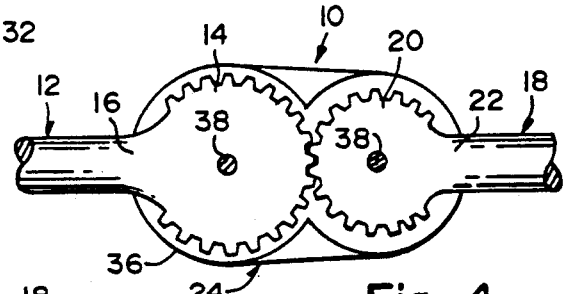
FIG. 4 is an enlarged cross sectional view taken on line 4—4 in FIG. 3.
Figure 2:
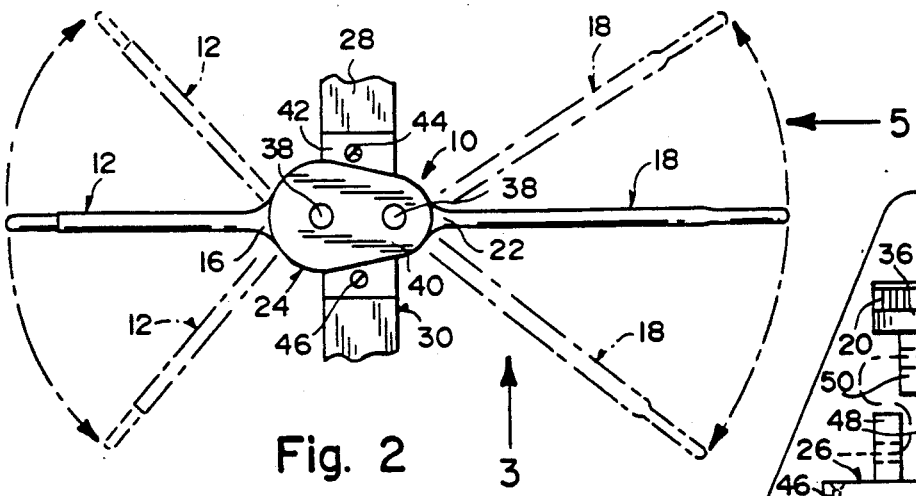
FIG. 2 is a diagrammatic top view taken in the direction of arrow 2 in FIG. 1 illustrating the horizontal movement of the oars.
Figure 5:
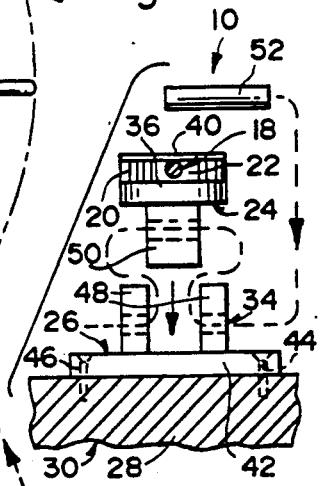
FIG. 5 is an exploded diagrammatic view taken in the direction of arrow 5 in FIG. 2.

Turning now descriptively to the drawings, in which like reference characters denote like elements throughout the several views, the Figures illustrate a reverse boat oar 10 consisting of an oar handle arm 12 having a large gear portion 14 formed on its distal end 16 and an oar paddle arm 18 having a small gear portion 20 formed on its distal end 22. A mechanism 24 is for holding the large gear portion 14 and the small gear portion 20 in a meshing rotatable relationship. An oar lock 26 is to attach the holding mechanism 24 to a gunwale 28 of a boat 30. When a rower pushed forward on the oar handle arm 12 the oar paddle arm 18 will also go forward. When the rower pulls back on the oar handle arm 12 the oar paddle arm 18 will travel back. This allows the rower to sit facing the bow 32 of the boat so as to see where the boat 30 is going.

Another mechanism 34 between the holding mechanism 24 and the oar lock 26 is for allowing the holding mechanism 24 with the oar handle arm 12 and the oar paddle arm 18 to seesaw up and down over the gunwale 28.

The holding mechanism 24 includes a housing 36 sized to receive the large gear portion 14 and the small gear portion 20. The housing 36 has a wide end and a narrow end sized to receive the large gear rotation and the small gear portion respectively. A shaft 38 extends through the center of the large gear portion 14 and the small gear portion 20 and the housing 36 so that the gear portions 14 and 20 can mesh together. A top cover 40 fits over the gear portions 14 and 20 in the housing 36 to prevent external objects from contacting the gear portions 14 and 20.

The oar lock 26 is a mounting plate 42 having openings 44 to receive screws 46 for securement onto the top of the gunwale 28 of the boat 30.

Figure 3:
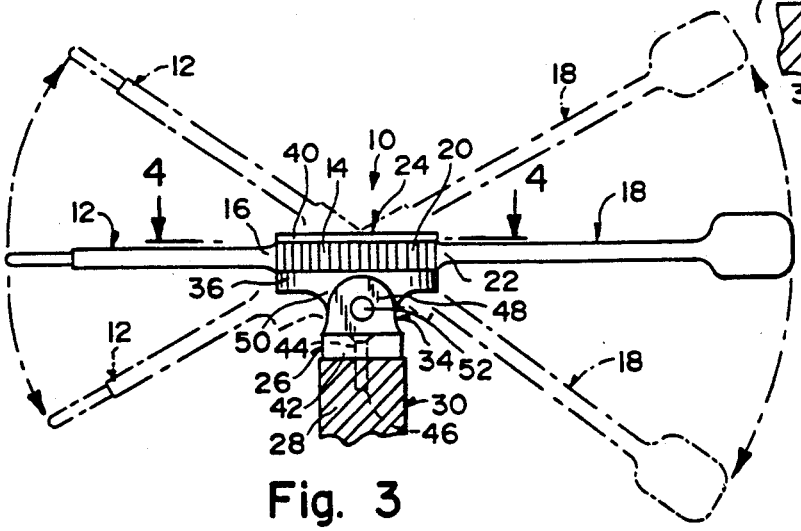
FIG. 3 is a side view thereof taken in the direction of arrow 3 in FIG. 2.

The seesaw allowing mechanism 34 includes a pair of upwardly extending lugs 48 on the mounting plate 42. A downwardly projecting lug 50 is on the underside of the housing 36. Lug 50 and a portion of housing 36 are received between lugs 48 as is shown in FIG. 3. An axle pin 52 is for rotatively joining the upwardly extending lugs 48 to the downwardly projecting lug 50 can either be force fitted in one of the lugs 48 or secured with cotter pins not not shown.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A reverse boat oar comprising:

a) an oar handle arm having a large gear portion formed on its distal end;

b) an oar paddle arm having a small gear portion formed on its distal end;

c) means for holding the large gear portion and the small gear portion in a meshing rotative relationship comprising a housing having a wide end and a narrow end sized to receive the large gear portion and the small gear portion respectively;

a pair of shafts, each extending through the center of the large gear portion and the small gear portion and said housing so that said gear portions can mesh together;

a top cover to fit over said gear portions in said housing to prevent external objects from contacting said gear portions; and d) an oar lock to attach said holding means to a gunwale of a boat, comprising an elongate mounting plate having openings, to receive screws for securement onto the top of the gunwale of the boat, a pair of upwardly extending lugs on said mounting plate;

a downwardly projection lug on the underside of said housing received together with a portion of the housing intermediate the ends between the lugs; and an axle pin force fitted in at least one of said upwardly extending lugs for rotatively securing said upwardly extending lugs to said downwardly projecting lug and permitting said holding means with said oar handle arm and said oar paddle arm to seesaw up and down on the gunwale.

* * * * *